US010935042B2

(12) United States Patent
Guo et al.

(10) Patent No.: US 10,935,042 B2
(45) Date of Patent: Mar. 2, 2021

(54) FAN BLADE MOUNTING STRUCTURE FOR CEILING FAN, AND CEILING FAN HAVING SAME

(71) Applicants: GD MIDEA ENVIRONMENT APPLIANCES MFG CO., LTD., Zhongshan (CN); MIDEA GROUP CO., LTD., Foshan (CN)

(72) Inventors: Yuqiang Guo, Zhongshan (CN); Xinmin Tang, Zhongshan (CN); Ying Tong, Zhongshan (CN)

(73) Assignees: GD MIDEA ENVIRONMENT APPLIANCES MFG CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 98 days.

(21) Appl. No.: 16/477,130

(22) PCT Filed: Mar. 24, 2017

(86) PCT No.: PCT/CN2017/078180
§ 371 (c)(1),
(2) Date: Jul. 10, 2019

(87) PCT Pub. No.: WO2018/129809
PCT Pub. Date: Jul. 19, 2018

(65) Prior Publication Data

US 2019/0360497 A1 Nov. 28, 2019

(30) Foreign Application Priority Data

Jan. 10, 2017 (CN) ..... 201710017054.2
Jan. 10, 2017 (CN) ..... 201710017566.9

(51) Int. Cl.
*F04D 25/08* (2006.01)
*F04D 29/34* (2006.01)

(52) U.S. Cl.
CPC ..... *F04D 29/34* (2013.01); *F04D 25/088* (2013.01)

(58) Field of Classification Search
CPC ..... F04D 25/088; F04D 29/34; F04D 29/64
See application file for complete search history.

(56) References Cited

U.S. PATENT DOCUMENTS 6,371,729 B1 4/2002 Tseng
6,666,652 B2 12/2003 Bucher et al.
(Continued)

FOREIGN PATENT DOCUMENTS

CN 206468552 U 9/2017
EP 1085216 A2 3/2001
EP 1085216 A2 * 3/2001 ..... F04D 25/088

OTHER PUBLICATIONS

The European Patent Office (EPO) Extended Search Report for EP Application No. 17891961.9 dated Dec. 9, 2019 4 Pages.
(Continued)

*Primary Examiner* — Richard A Edgar
(74) *Attorney, Agent, or Firm* — Anova Law Group PLLC

(57) ABSTRACT

A ceiling fan blade mounting structure includes a blade holding base and a fastening assembly. The blade holding base includes a plurality of connection members spaced apart from each other. The fastening assembly includes a wedging member, a rotating block, and a fastening member. The wedging member is fastened with one of the plurality of connection members. A first end of the rotating block is rotatably connected to the wedging member. A first end of the fastening member is rotatably connected to a second end of the rotating block. The fastening member is configured to rotate about the rotating block to cause a second end of the
(Continued)

fastening member to be fastened with another one of the plurality of connection members.

17 Claims, 11 Drawing Sheets

(56) References Cited

U.S. PATENT DOCUMENTS

| | | | |
|---|---|---|---|
| 8,221,077 | B2 | 7/2012 | Pelshak et al. |
| 2010/0124504 | A1 | 5/2010 | Yao |
| 2010/0284813 | A1 | 11/2010 | Wang |

OTHER PUBLICATIONS

World Intellectual Property Organization (WIPO) International Search Report for PCT/CN2017/078180 dated Oct. 17, 2017 6 Pages.
World Intellectual Property Organization (WIPO) Written Opinion for PCT/CN2017/078180 dated Oct. 17, 2017 8 Pages.

* cited by examiner

FAN BLADE MOUNTING STRUCTURE FOR CEILING FAN, AND CEILING FAN HAVING SAME

CROSS-REFERENCE TO RELATED APPLICATIONS

This application is a National Stage Entry under 35 U.S.C. § 371 of International Application No. PCT/CN2017/078180, filed on Mar. 24, 2017, which claims priority to Chinese Application Nos. 201710017054.2 and 201710017566.9, both filed on Jan. 10, 2017, the entire contents of all of which are incorporated herein by reference.

FIELD

The present disclosure relates to a technical field of fans and particularly, to a ceiling fan blade mounting structure, and to a ceiling fan having same.

BACKGROUND

A ceiling fan is a fan fixedly mounted onto a ceiling and has advantages such as energy conservation, convenience and practicability, thus it is well received by customers.

In the related art, typically, a fan blade of an existing ceiling fan has an end fixedly connected to a blade holding base by means of bolts or screws. As there are usually more than two fan blades on a ceiling fan and each fan blade is fixedly connected to the blade holding base by means of at least three bolts or screws, the connection between the fan blades and the blade holding base by means of the bolts or screws is inconvenient during assembling and disassembling.

SUMMARY

The present disclosure seeks to solve at least one of the technical problems existing in the related art. To this end, an objective of the present disclosure is to provide a ceiling fan blade mounting structure, aiming at facilitating mounting the fan blades onto and dismounting the fan blades from the blade holding base.

Another objective of the present disclosure is to propose a ceiling fan having the fan blade mounting structure.

The fan blade mounting structure for a ceiling fan according to a first aspect of the present disclosure includes: a blade holding base provided with a plurality of connection members spaced apart from each other; a fan blade arranged on the blade holding base and including a plurality of connection holes, the plurality of connection holes being in one-to-one correspondence with the plurality of connection members, and the connection members running through the connection holes; and a fastening assembly including a wedging member, a rotating block and a fastening member, the wedging member being fastened with one of the plurality of connection members and abutting and tightly pressing the fan blade against the blade holding base, the rotating block having a first end rotatably connected to the wedging member and a second end rotatably connected to a first end of the fastening member, and the fastening member rotating about the rotating block such that a second end of the fastening member is fastened with another one of the plurality of connection members.

According to an example of the present disclosure, each connection member includes a first column fixedly connected to the blade holding base, the first column has an end away from the blade holding base and provided with a first flange, the wedging member includes two wedging portions, the two wedging portions define a first insertion opening therebetween, the first column of the one of the plurality of connection members is snapped into the first insertion opening, and the first flange tightly presses the two wedging portions.

According to an example of the present disclosure, the fastening member includes a first bottom plate, as well as a first side plate, a second side plate and a third side plate each connected to an edge of the first bottom plate and extending toward the fan blade, the first side plate and the second side plate are oppositely arranged, the third side plate is provided with a first fastening portion extending toward the wedging member, the first fastening portion includes a second insertion opening, the fastening member rotates about the rotating block such that the first column of the another one of the plurality of connection members slides into the second insertion opening and the first flange tightly presses edges on both sides of the second insertion opening.

According to an example of the present disclosure, the wedging member further includes two first connecting arms connected to the wedging portions, the rotating block includes a first end extending into a position between the two first connecting arms, first through holes matching each other are formed at the two first connecting arms and the first end of the rotating block, respectively, and the wedging member is hinged to the rotating block by means of a first rivet running through the first through hole on each of the two first connecting arms and the first end of the rotating block.

According to an example of the present disclosure, the rotating block further includes a second end arranged between the first side plate and the second side plate, second through holes matching each other are formed at the second end, the first side plate and the second side plate, respectively, and the fastening member is hinged to the rotating block by means of a second rivet running through the second through holes of the first side plate, the second end and the second side plate sequentially.

According to an example of the present disclosure, the wedging member has at least two wedging arms, and two wedging arms are fastened with two of the plurality of connection members respectively and abut and tightly press the fan blade against the blade holding base.

According to an example of the present disclosure, two wedging arms are provided, and the two wedging arms have first ends connected to each other and second ends extending away from each other.

According to an example of the present disclosure, each connection member includes a second column fixedly connected to the blade holding base, the second column has an end away from the blade holding base and provided with a second flange, a third insertion opening is formed at an end portion of each of the wedging arms, the second column of the connection member mated with the wedging member is snapped into the third insertion opening, and the second flange tightly presses the wedging arm.

According to an example of the present disclosure, the fastening member includes a second bottom plate, as well as a fourth side plate, a fifth side plate and a sixth side plate each connected to an edge of the second bottom plate and extending toward the fan blade, the fourth side plate and the fifth side plate are oppositely arranged, the sixth side plate is provided with a second fastening portion extending toward the wedging member, the second fastening portion includes a fourth insertion opening, and the fastening member rotates about the rotating block such that the second column of the another one of the plurality of connection members slides into the fourth insertion opening and the second flange tightly presses edges on both sides of the fourth insertion opening.

According to an example of the present disclosure, the wedging member further includes a second connecting arm, the second connecting arm is connected to the wedging arm, the rotating block has a first end, a limiting groove is formed at the first end of the rotating block, the connecting arm extends into the limiting groove, third through holes matching each other are formed at the connecting arm and the first end of the rotating block, respectively, and the wedging member is hinged to the rotating block by means of a third rivet running through the third through hole on each of the connecting arm and the first end of the rotating block.

According to an example of the present disclosure, the rotating block further includes a second end arranged between the fourth side plate and the fifth side plate, fourth through holes matching each other are formed at the second end of the rotating block, the fourth side plate and the fifth side plate, respectively, and the fastening member is hinged to the rotating block by means of a fourth rivet running through the fourth through holes of the fourth side plate, the second end of the rotating block and the fifth side plate sequentially.

According to an example of the present disclosure, three connection members are provided, and the three connection members are arranged in a shape of an isosceles triangle.

According to an example of the present disclosure, the wedging member and the rotating block are located in a space covered by the fastening member.

According to an example of the present disclosure, the blade holding base further includes at least two pins, the fan blade includes mounting holes equal in number to that of the pins, and the pins are inserted into the mounting holes.

According to an example of the present disclosure, the at least two pins are oppositely provided on both sides of a line connecting the two connection members.

A ceiling fan according to a second aspect of the present disclosure includes the fan blade mounting structure according to the first aspect of the present disclosure.

According to the technical solution of the present disclosure, the blade holding base is connected to the plurality of connection members, and the fan blade has connection holes whose number is the same as the number of the connection members, and a fastening assembly is further provided. The connection members of the blade holding base are aligned with the connection holes in the fan blade, the connection members run through the connection holes, and the wedging member of the fastening assembly wedges and presses the fan blade tightly and is fastened with one connection member. Because the fastening member, the rotating block and the wedging member in the fastening assembly are rotatably connected, the fastening member may be turned with respect to the rotating block. The fastening member is fastened with another connection member after being turned by a certain angle. Through rotations of the rotating block and the fastening member, the fastening member moves relative to the connection member connected thereto, such that the connection member further slides into the fastening member, and a fastening structure between the fastening member and the connection member is thus tightened. In this manner, the connection between the fan blade and the blade holding base may be tightened without screws, thereby greatly facilitating mounting the fan blade onto and dismounting the fan blade from the blade holding base.

Additional aspects and advantages of the present disclosure will be given in the following description, some of which will become apparent from the following description or be learned from practices of the present disclosure.

BRIEF DESCRIPTION OF THE DRAWINGS

The above and/or additional aspects and advantages of the present disclosure will become apparent and easy to understand from descriptions of the embodiments with reference to the drawings.

REFERENCE NUMERALS OF THE ACCOMPANYING DRAWINGS

Figure 1:
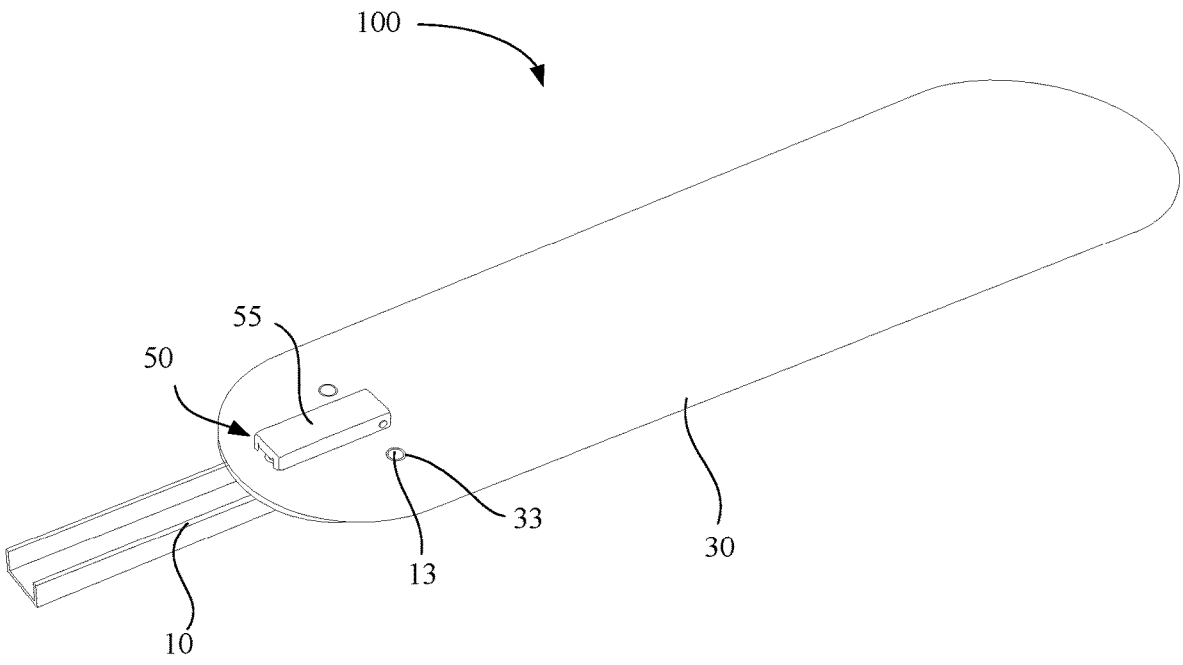
FIG. 1 is a schematic structural view of a ceiling fan blade mounting structure according to embodiments of the present disclosure.
Figure 2:
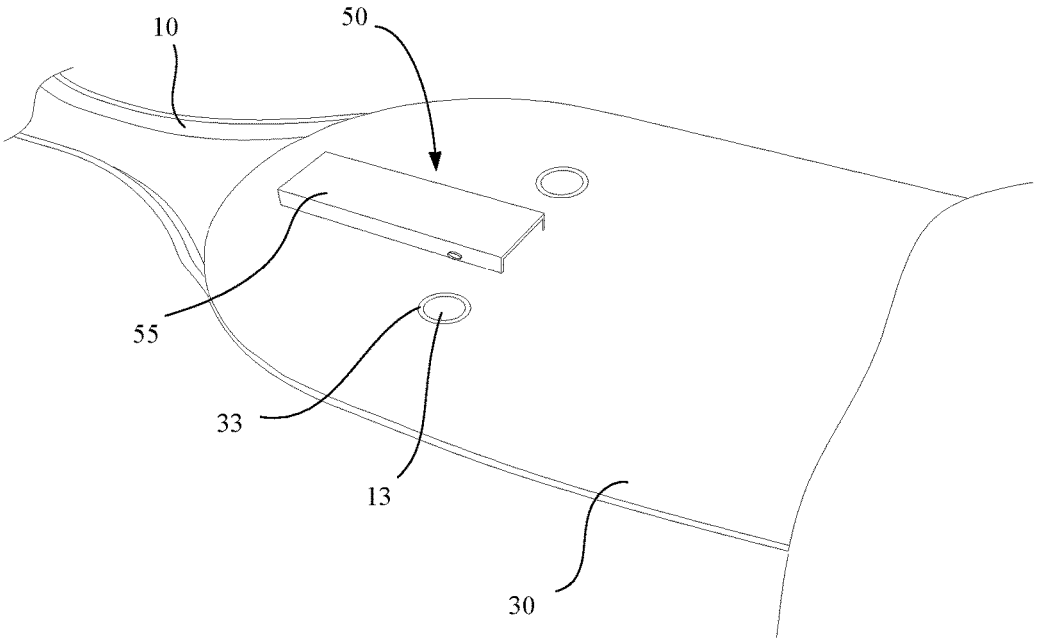
FIG. 2 is a schematic structural view of the ceiling fan blade mounting structure in FIG. 1 from another perspective.

| Reference numeral | Name | Reference numeral | Name |
|---|---|---|---|
| 100 | ceiling fan blade mounting structure | 515 | first connecting arm |
| 10 | blade holding base | 53 | rotating block |
| 11 | connection member | 531 | first end |

-continued

| Reference numeral | Name | Reference numeral | Name |
|---|---|---|---|
| 111 | first column | 533 | second end |
| 113 | first flange | 55 | fastening member |
| 13 | pin | 551 | first bottom plate |
| 30 | fan blade | 552 | first side plate |
| 31 | connection hole | 554 | second side plate |
| 33 | mounting hole | 555 | third side plate |
| 50 | fastening assembly | 557 | first fastening portion |
| 51 | wedging member | 559 | second insertion opening |
| 511 | wedging portion | 57 | second rivet |
| 513 | first insertion opening | 535 | limiting groove |
| 111' | second column | 533 | second end |
| 113' | second flange | 551' | second bottom plate |
| 56 | third rivet | 552' | fourth side plate |
| 511' | wedging arm | 554' | fifth side plate |
| 513' | third insertion opening | 555' | sixth side plate |
| 515' | second connecting arm | 557' | second fastening portion |
| 57' | fourth rivet | 559' | fourth insertion opening |

The objective realization, functional features and advantages of the present disclosure will be further described with reference to embodiments and drawings.

DETAILED DESCRIPTION

Embodiments of the present disclosure are described below in detail, examples of the embodiments are shown in accompanying drawings, and the same or similar elements and the elements having same or similar functions are denoted by like reference numerals throughout the descriptions. The embodiments described below with reference to the accompanying drawings are exemplary, are merely used to explain the present disclosure, and cannot be construed as a limit to the present disclosure.

In the description of the present disclosure, it needs to be understood that orientation or position relationships indicated by the terms "central", "up", "down", "front", "rear", "left", "right", "vertical", "horizontal", "top", "bottom", "inside" and "outside" are orientation or position relationships that are shown based on the accompanying drawings, and are merely used for ease of description of the present disclosure and used to simplify description, but do not indicate or imply that the discussed devices or elements must have specific orientations or must be built and operated according to specific orientations, and therefore should not be construed as a limitation to the present disclosure.

It needs to be noted that terms "first" and "second" are merely used for the purpose of description, but should not be understood as an indication or an implication of relative importance or an implicit indication of a quantity of indicated technical features. As such, a feature preceded by "first" and "second" may explicitly or implicitly include one or more such features. Furthermore, in the description of the present disclosure, the meaning of "a plurality of" is two or more than two, unless otherwise specified.

The present disclosure provides a ceiling fan blade mounting structure 100.

As illustrated in FIG. 1 to FIG. 13, the ceiling fan blade mounting structure 100 according to embodiments of a first aspect of the present disclosure includes a blade holding base, a fan blade and a fastening assembly.

Specifically, the blade holding base is provided with a plurality of connection members spaced apart from each other. The fan blade is disposed on the blade holding base. The fan blade includes a plurality of connection holes. The plurality of connection holes are in one-to-one correspondence with a plurality of connection members, and each connection member runs through the corresponding connection hole. The fastening assembly includes a wedging member, a rotating block and a fastening member. The wedging member is fastened with one of the plurality of connection members, and abuts and tightly presses the fan blade against the blade holding base. The rotating block has a first end rotatably connected to the wedging member and a second end rotatably connected to a first end of the fastening member. The fastening member rotates about the rotating block, such that a second end of the fastening member is fastened with another one of the plurality of connection members.

For the ceiling fan blade mounting structure 100 according to embodiments of the present disclosure, the blade holding base is connected to the plurality of connection members, and the fan blade includes connection holes whose number is the same as the number of the connection members, and a fastening assembly is further provided. The connection members of the blade holding base are aligned with the connection holes in the fan blade, the connection members run through the connection holes, and the wedging member of the fastening assembly wedges and presses the fan blade tightly and is fastened with one connection member. Because the fastening member, the rotating block and the wedging member in the fastening assembly are rotatably connected, the fastening member may be turned with respect to the rotating block. The fastening member is fastened with another connection member after being turned by a certain angle. Through rotations of the rotating block and the fastening member, the fastening member moves relative to the connection member connected thereto, such that the connection member further slides into the fastening member, and a fastening structure between the fastening member and the connection member is thus tightened. In this manner, the connection between the fan blade and the blade holding base may be tightened without screws, thereby greatly facilitating mounting the fan blade onto and dismounting the fan blade from the blade holding base.

The ceiling fan blade mounting structure 100 according to a plurality of embodiments of the present disclosure will be described in detail with reference to FIG. 1 to FIG. 13.

Embodiment 1

In this embodiment, as illustrated in FIG. 1 to FIG. 8, the ceiling fan blade mounting structure 100 includes a blade holding base 10, a fan blade 30 and a fastening assembly 50. The blade holding base 10 is provided with at least two connection members 11 spaced apart from each other. The fan blade 30 defines at least two connection holes 31. One connection member 11 runs through one connection hole 31, such that the connection members 11 are in one-to-one correspondence with the connection holes 31. The fastening assembly 50 includes a wedging member 51, a rotating block 53 and a fastening member 55. The wedging member 51 is fastened with one connection member 11, and abuts and tightly presses against the fan blade 30. The rotating block 53 has a first end rotatably connected to the wedging member 51 and a second end rotatably connected to a first end of the fastening member 55. The fastening member 55 rotates about the rotating block 53, such that a second end of the fastening member 55 is fastened with the other one connection member 11.

The ceiling fan blade mounting structure 100 according to the present embodiment may be applied to a conventional ceiling fan, i.e., a ceiling fan having a function of driving indoor air to flow. The fan blade mounting structure may also be applied to a ceiling fan-lamp that further has a decorative function due to the combination of a lamp and a ceiling fan. Specifically, metal alloys may be used for the fan blade 30, such that wind produced by such a ceiling fan is relatively strong. Of course, the fan blade 30 may also be made of a wood composite board with a relatively high strength, and a textured pattern may be formed on the surface of the fan blade 30, which not only forms a pleasant appearance, but also makes little noise during its operation. The blade holding base 10 may be made of metal materials like cast iron and manufactured by die casting. The surface of the blade holding base 10 may also be made in faded bronze, such that the overall ceiling fan is more pleasing to the eye.

During assembling, a first end of the blade holding base 10 is fixedly connected to the ceiling fan through a rotator driven by a motor, and the fan blade 30 is held by and fixed to a second end of the blade holding base 10. Driven by the motor, the rotator drives the fan blade 30 to rotate around the rotator, so as to realize indoor air convection through blowing indoor air.

According to the technical solution of the present disclosure, at least two connection members 11 are connected to the blade holding base 10. The fan blade 30 includes at least two connection holes 31, and a fastening assembly 50 is further provided. The connection members 11 of the blade holding base 10 are aligned with the connection holes 31 in the fan blade 30, the connection members 11 run through the connection holes 31, and the wedging member 51 of the fastening assembly 50 wedges and presses the fan blade 30 tightly and is fastened with one connection member 11. Because the fastening member 55, the rotating block 53 and the wedging member 51 in the fastening assembly 50 are rotatably connected, the fastening member 55 may be turned with respect to the wedging member 51. The fastening member 55 is fastened with the other one connection member 11 after being turned by a certain angle. Through rotations of the rotating block 53 and the fastening member 55 at the hinged portion, the fastening member 55 moves relative to the connection member 11 connected thereto, such that the connection member 11 further slides into the fastening member 55, and a fastening structure between the fastening member 55 and the connection member 11 is thus tightened. In this manner, the connection between a fan blade box and the blade holding base 10 may be tightened without screws, thereby greatly facilitating mounting the fan blades 30 onto and dismounting the fan blades 30 from the blade holding base 10.

Furthermore, in this technical solution, on the basis that the blade holding base 10 is connected to the fan blade 30 through an engagement between the connection member 11 and the connection hole 31, the blade holding base 10 further includes at least two pins 13. The fan blade 30 includes mounting holes 33 equal in number to that of the pins 13. In this manner, the number of the pins 13 is equal to that of the mounting holes 33, that is, one pin 13 is inserted into one mounting hole 33.

Two pins 13 are provided in the present embodiment, and at least two pins 13 are oppositely provided on two sides of a line connecting the two connection members 11. During the assembling of the fan blade 30 and the blade holding base 10, when the connection members 11 pass through the connection holes 31, the pins 13 are also inserted into the mounting holes 33. For the reason that a connection structure between the fan blade 30 and the blade holding base 10 bears relatively strong shear force during the operation of the ceiling fan, the pins 13 may share some of the shear force exerted on the connection members 11, such that the connection structure between the fan blade 30 and the blade holding base 10 has a higher strength.

Specifically, each connection member 11 includes a first column 111 fixedly connected to the blade holding base 10. An end of the first column 111 away from the blade holding base 10 is provided with a first flange 113. The wedging member 51 includes two wedging portions 511. A first insertion opening 513 is defined between the two wedging portions 511. The first column 111 of the above one of the plurality of connection members 11 is snapped into the first insertion opening 513, and the first flange 113 is tightly pressed on the two wedging portions 511. That is, the first column 111 of the connection member 11 mated with the wedging member 51 is snapped into the first insertion opening 513, and two sides of the first flange 113 of the connection member 11 are tightly pressed onto the two wedging portions 511, respectively.

During a molding process of the connection member 11, a cylindrical protrusion with a threaded hole can be integrally molded with the blade holding base 10 during the die casting. And then, a partially-threaded screw is screwed into the cylindrical protrusion, thus the partially-threaded screw and the cylindrical protrusion constitute the connection member 11 in the present embodiment. Specifically, the first column 111 may be a non-threaded screw arbor of the partially-threaded screw, and the first flange 113 may be a cap of the partially-threaded screw. Of course, the connection member 11 may also be integrally formed with the blade holding base 10. The connection member 11 according to the present embodiment is separate from the blade holding base 10, which may reduce molding cost of the blade holding base 10.

Optionally, the wedging member 51 in the present embodiment is a metal die-casting part, and the wedging portion 511 has a certain thickness. In this manner, after the first column 111 of the connection member 11 is snapped into the first insertion opening 513, both of surfaces of the fan blade 30 and the first flange 113 are pressed on two corresponding surfaces of the wedging portion 511, such that the fan blade 30 may be prevented from moving in an axial direction of the connection member 11. Accordingly, a ceiling fan having the fan blade mounting structure according to the present disclosure has a relatively high structural strength during operation. In this embodiment, the wedging member 51 is fastened with the connection member 11 through slidable insertion, thus the installation is easy.

Specifically, the fastening member 55 includes a first bottom plate 551, as well as a first side plate 552, a second side plate 554 and a third side plate 555 each connected to an edge of the first bottom plate 551 and extending toward a side (for example, a side where the fan blade 30 is) of the first bottom plate 551. The first side plate 552 and the second side plate 554 are oppositely arranged. The third side plate 555 is provided with a first fastening portion 557 extending toward (for example, toward the wedging member) a position between the first side plate 552 and the second side plate 554. The first fastening portion 557 includes a second insertion opening 559. The fastening member 55 rotates about the rotating block 53, such that the first column 111 of the another one of the plurality of connection members 11 slides into the second insertion opening 559 and the first flange 113 is tightly pressed on edges on both sides of the second insertion opening 559. In other words, the fastening member 55 is turned about the rotating block 53, such that the first column 111 of the connection member 11 mated with the fastening member 55 slides into the second insertion opening 559, and the first flange 113 of the connection member 11 is tightly pressed onto edges on both sides of the second insertion opening 559.

Optionally, the fastening member 55 is a plate made by stamping and bending. After the wedging member 51 is fastened with one of the connection members 11, the fastening member 55 is turned about the rotating block 53 such that the first fastening portion 557 faces an opening end of the second insertion opening 559. Since the fastening member 55, the rotating block 53 and the wedging member 51 are hinged with each other, when the second insertion opening 559 faces the first column 111 of the connection member 11 after the fastening member 55 is turned about the rotating block 53 by a certain angle, the fastening member 55 and the connection member 11 slide relative to each other under the action of a force applied to the fastening member 55, such that the first column 111 of the connection member 11 slides and is snapped into the second insertion opening 559, and two sides of the first flange 113 of the connection member 11 are respectively tightly pressed onto the edges on the two sides of the second insertion opening 559. The whole installation process is convenient and the connection structure is relatively firm.

In this embodiment, after the fastening member 55 is fastened with the connection member 11, the wedging member 51 and the rotating block 53 rotate with respect to each other, thereby forming an open configuration as a hinge. In addition, the wedging member 51 and the rotating block 53 are located in a space covered by the fastening member 55. The fastening member 55 hides the wedging member 51 and the rotating block 53. Accordingly, the entire structure is simple. In addition, it is possible to avoid noises made by the exposed wedging member 51 and rotating block 53 during the rotation of the ceiling fan after the installation is finished.

Figure 3:
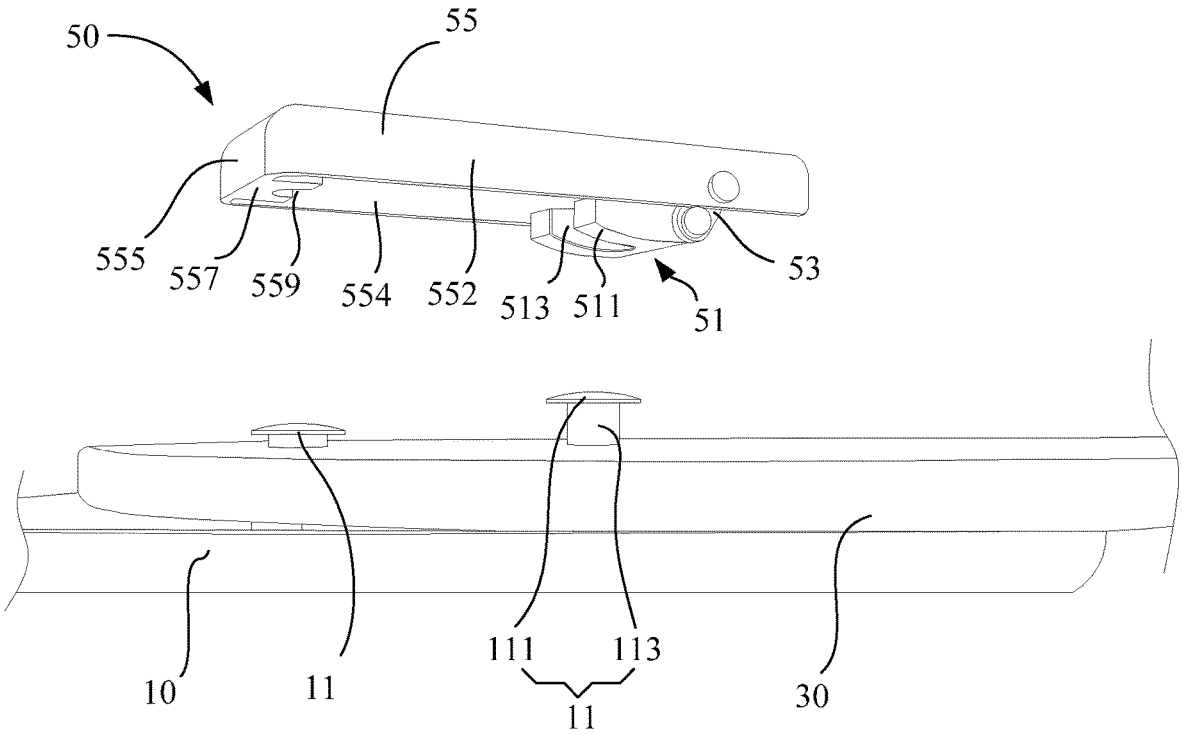
FIG. 3 is an exploded structural view of the ceiling fan blade mounting structure in FIG. 1, in which a fastening assembly is disengaged from a connection member.
Figure 4:
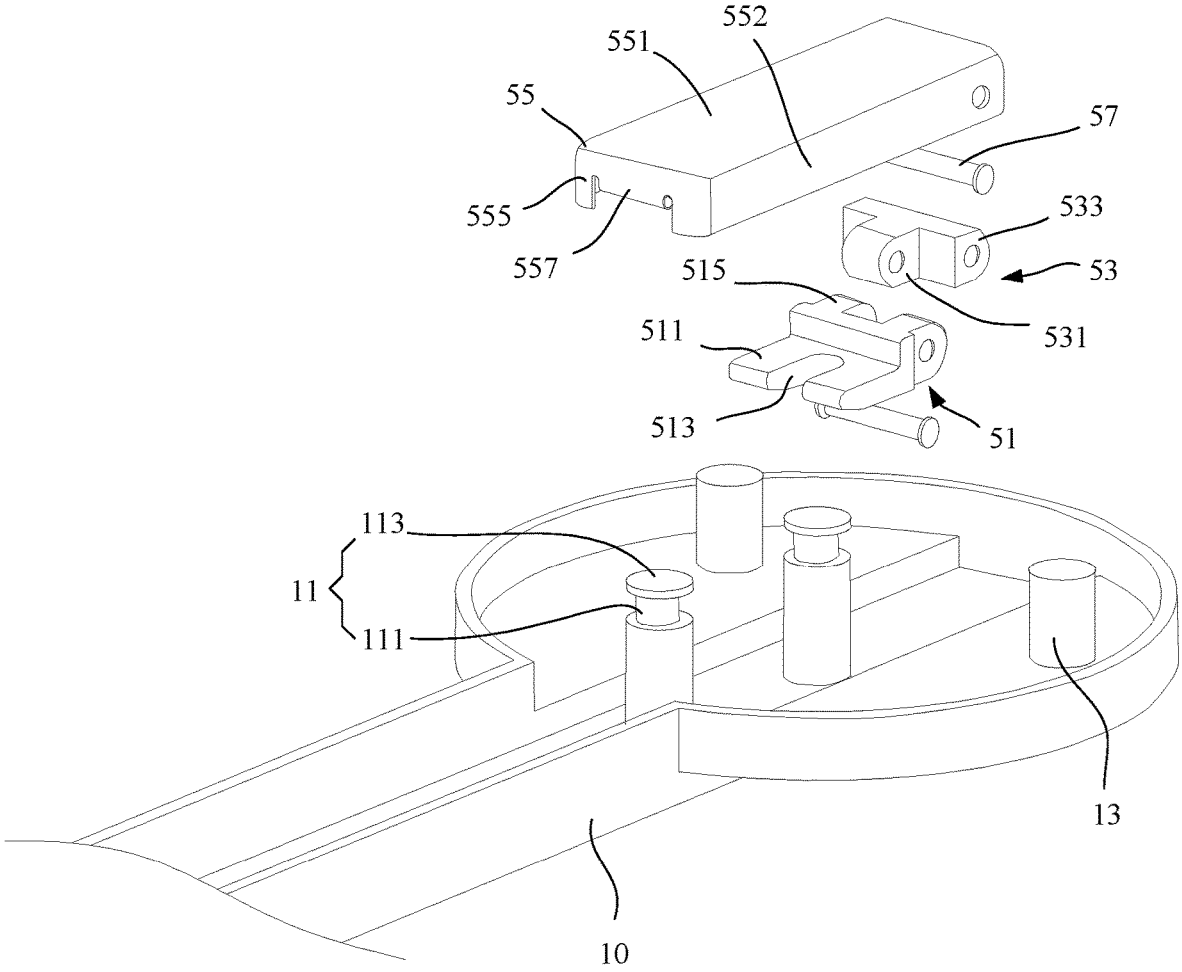
FIG. 4 is an exploded structural view of part of the ceiling fan blade mounting structure in FIG. 1, in which no fan blade is illustrated.
Figure 5:
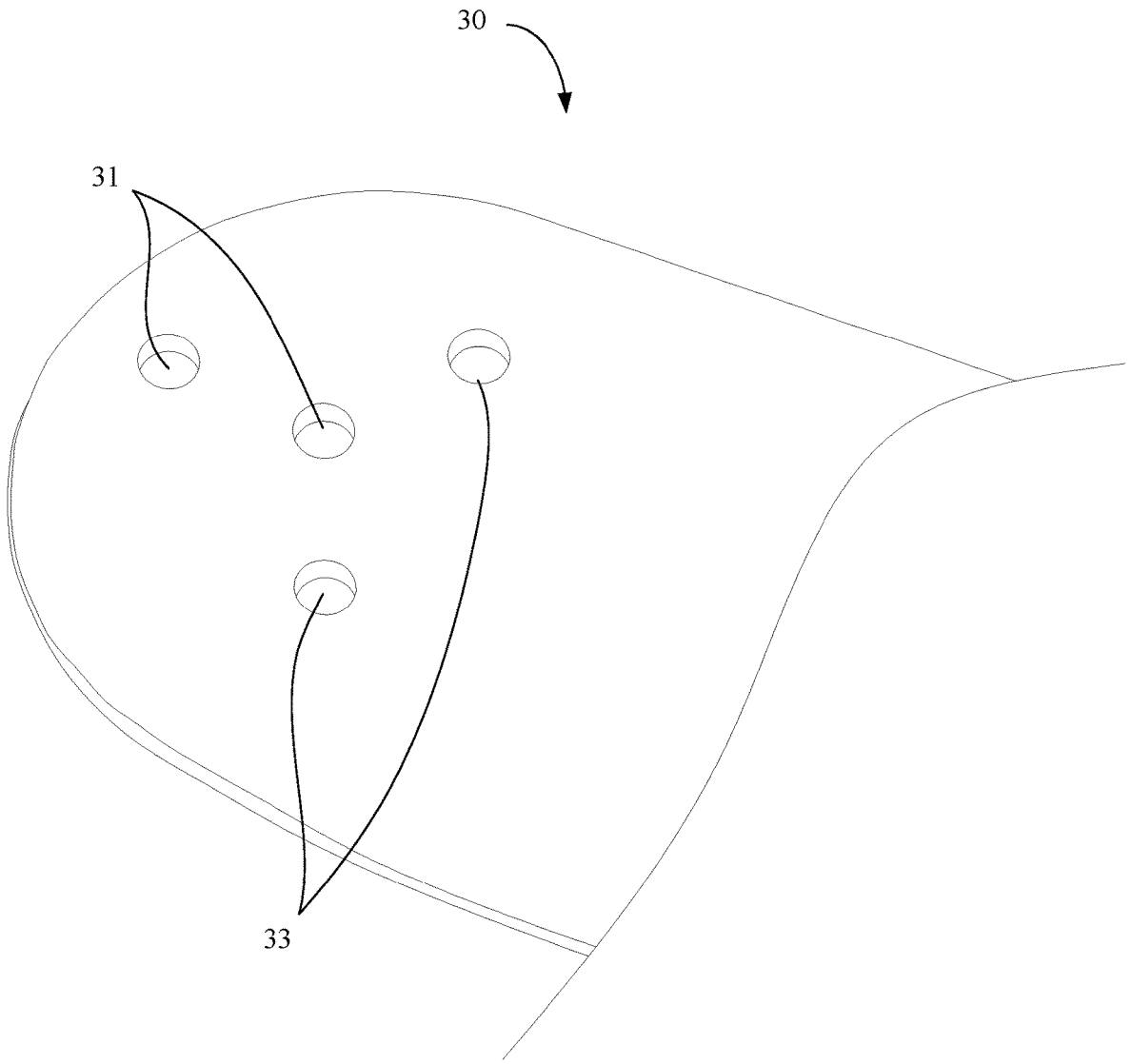
FIG. 5 is a partial schematic structural view of a fan blade of a ceiling fan blade mounting structure according to embodiments of the present disclosure.

The hinged structure formed by the fastening member 55, the rotating block 53 and the wedging member 51 will be described in detail with reference to FIG. 3 and FIG. 4.

The wedging member 51 further includes two first connecting arms 515 connected to the wedging portions 511. The rotating block 53 has a first end 531 extending into a position between the two first connecting arms 515. First through holes matching each other are formed at the two first connecting arms 515 and the first end 531 of the rotating block 53, respectively. The wedging member 51 is hingedly connected to the rotating block 53 by means of a first rivet running through the first through hole on each of the first connecting arms 515 and the first end 531 of the rotating block 53. Optionally, the rotating block 53 may be a die-casting part. With the first end 531 restricted between the two first connecting arms 515, the rotating block 53 is less likely to swing when it rotates about the first rivet.

Furthermore, the rotating block 53 further includes a second end 533 extending into a position between the first side plate 552 and the second side plate 554 of the fastening member 55. Second through holes matching each other are formed at the second end 533 of the rotating block 53, the first side plate 552 and the second side plate 554, respectively. The fastening member 55 is hingedly connected to the rotating block 53 by means of a second rivet 57 running through the second through holes of the first side plate 552, the second end 533 and the second side plate 554 sequentially. Similarly, the first side plate 552 and the second side plate 554 of the fastening member 55 restrict the second end 533 of the rotating block 53, thus the fastening member 55 moves more stably during the rotation.

The assembling process of the ceiling fan blade mounting structure 100 is described as follows.

Figure 6:
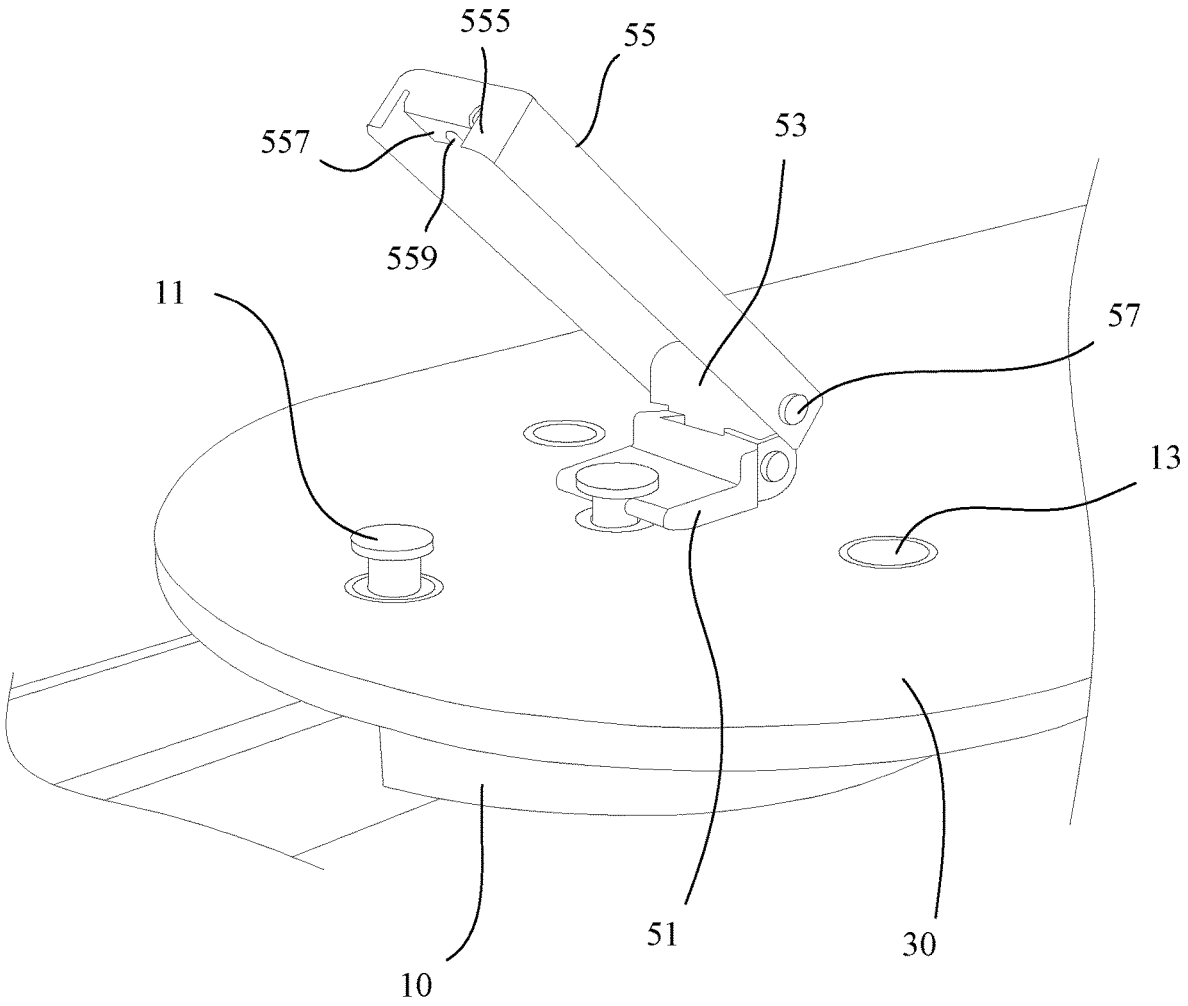
FIG. 6 is a schematic structural view of a ceiling fan blade mounting structure according to embodiments of the present disclosure, in which the fan blade mounting structure is in a first mounting state, and a wedging member is fastened with a connection member.

As illustrated in FIG. 6, the connection members 11 and the pins 13 are inserted into the connection holes 31 and the mounting holes 33 respectively, and then the first insertion opening 513 of the wedging member 51 and one connection member 11 are aligned. A force is applied to the fastening assembly 50 to make the first column 111 of the connection member 11 slide and snapped into the first insertion opening 513. Meanwhile, each of the two sides of the first flange 113 of the connection member 11 abuts against one wedging portion 511, such that the fan blade 30 is tightly connected to the blade holding base 10 through wedging and pressing by the wedging member 51.

Figure 7:
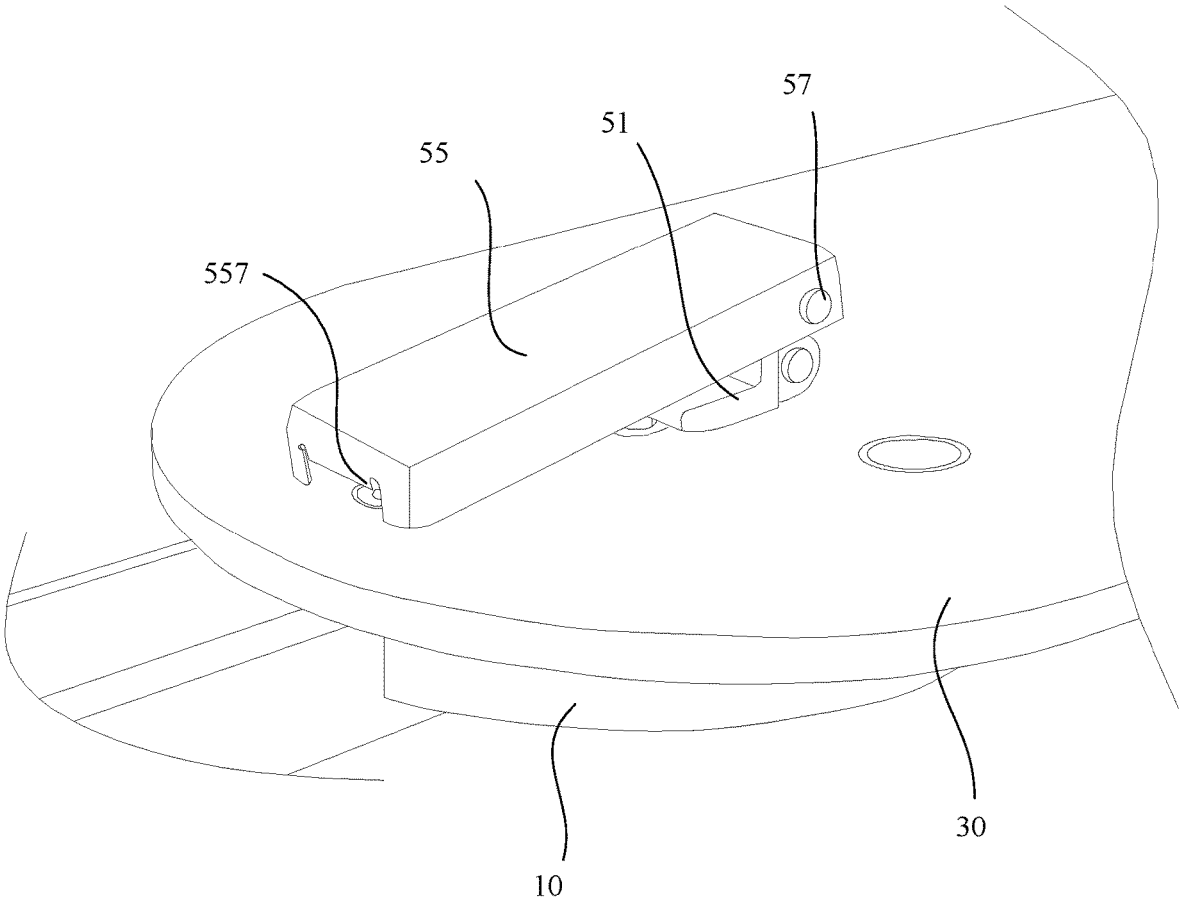
FIG. 7 is a schematic structural view of the ceiling fan blade mounting structure according to embodiments of the present disclosure, in which the fan blade mounting structure is in a second mounting state, and the fastening member is turned for a certain angle.

As illustrated in FIG. 7, a force is applied to the fastening member 55, the first fastening portion 557 of the fastening member 55 is turned to an external side of the connection member 11 mated with it, and the second insertion opening 559 faces the first column 111 of the connection member 11.

Figure 8:
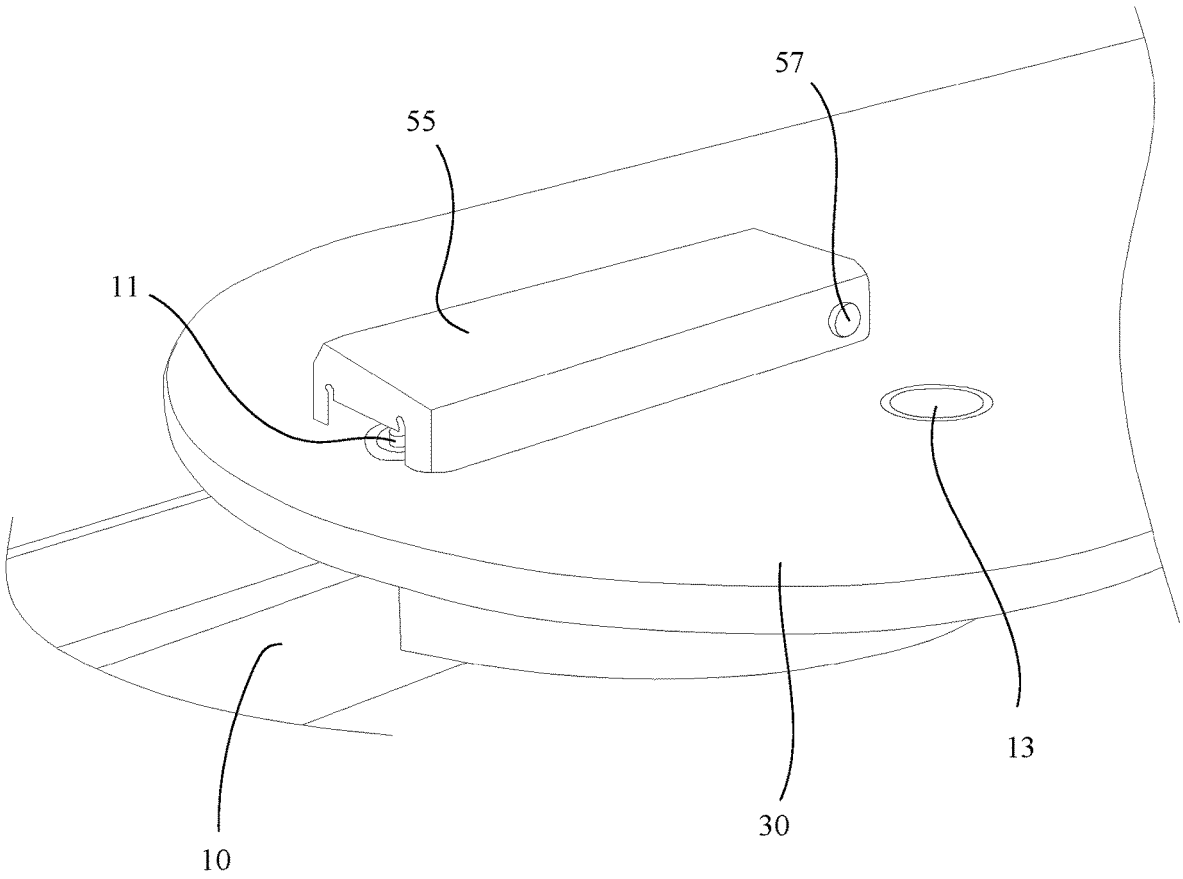
FIG. 8 is a schematic structural view of the ceiling fan blade mounting structure according to embodiments of the present disclosure, in which the fan blade mounting structure is in a third mounting state, and the fastening member is fastened with the connection member.
Figure 9:
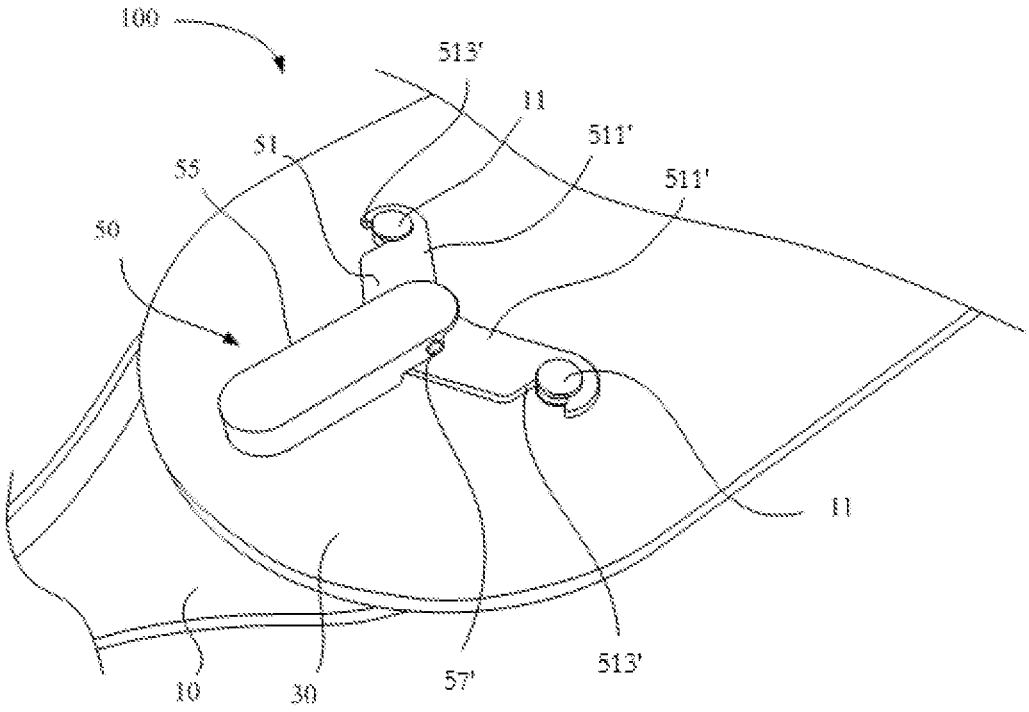
FIG. 9 is a schematic structural view of a ceiling fan blade mounting structure according to embodiments of the present disclosure.
Figure 10:
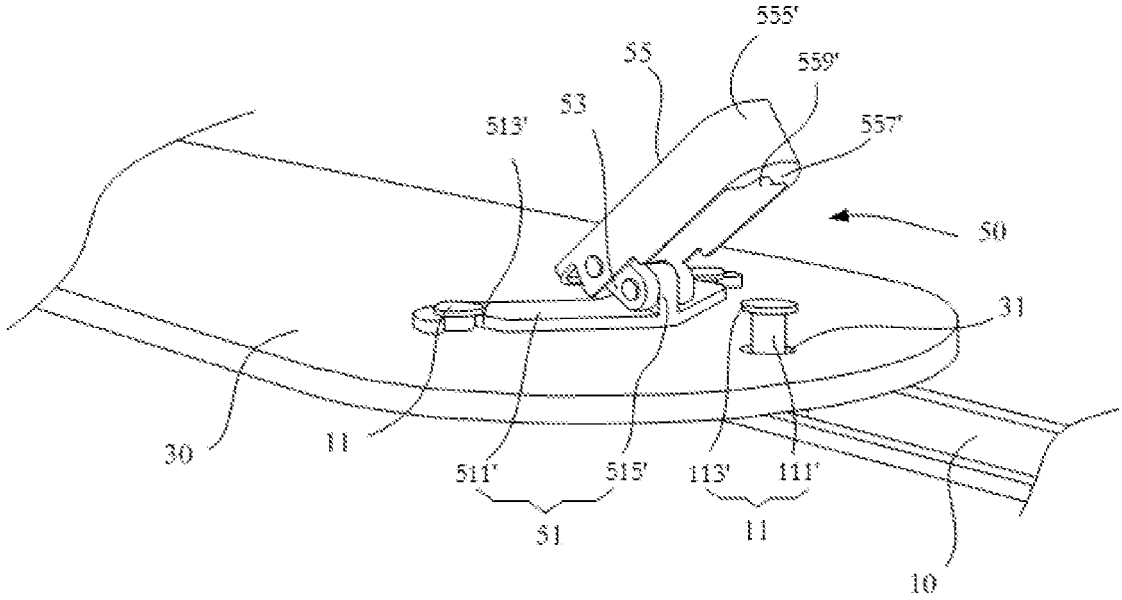
FIG. 10 is a schematic structural view of the ceiling fan blade mounting structure in FIG. 9 from another perspective.

As illustrated in FIG. 8, a further force is applied to the fastening member 55, the fastening member 55 tends to move to the wedging member 51 with the rotation between the fastening member 55 and the rotating block 53, such that the first column 111 of the connection member 11 slides and is snapped into the second insertion opening 559. At the same time, the first flange 113 of the connection member 11 is clamped at edges on both sides of the second insertion opening 559. And then, the fastening member 55 is pressed downwardly to make the wedging member 51 and the rotating block 53 rotate with respect to each other until the wedging member 51 and the rotating block 53 are in a state like an open hinge. In addition, the wedging member 51 and the rotating block 53 are hidden inside the fastening member 55. Through a self-locking function of the hinged structure of the fastening member 55, the rotating block 53 and the wedging member 51, a fastening structure between the fastening member 55 and the connection member 11 is fastened. The assembling of the fan blade 30 and the blade holding base 10 is thereby completed.

In the process of disassembling, a force is applied to an end of the fastening member 55 adjacent to the wedging member 51, such that the end of the fastening member 55 adjacent to the wedging member 51 is raised, and the fastening member 55 brings the rotating block 53 to turn. When an angle of about 90 degrees is formed between the rotating block 53 and the wedging member 51, a force is applied to the fastening member 55 to make the fastening member 55 and the connection member 11 slide relative to each other, such that the connection member 11 detaches from the fastening member 55. And then the wedging member 51 is pulled out. In this manner, a locking state between the fan blade 30 and the blade holding base 10 is released, and thus the fan blade 30 may be separated from the blade holding base 10.

Embodiment 2

In this embodiment, as illustrated in FIG. 9 to FIG. 13, the ceiling fan blade mounting structure 100 includes a blade holding base 10, a fan blade 30 and a fastening assembly 50. The blade holding base 10 is provided with a plurality of connection members 11 spaced apart from each other. The fan blade 30 includes a plurality of connection holes 31. One connection member 11 runs through one connection hole 31, such that the connection members 11 are in one-to-one correspondence with the connection holes 31. The fastening assembly 50 includes a wedging member 51, a rotating block 53 and a fastening member 55. The wedging member 51 has at least two wedging arms 511'. Two wedging arms 511' are fastened with two of the plurality of connection members 11 respectively and abut against and tightly press the fan blade 30 against the blade holding base 10. Each wedging arm 511' is fastened with one corresponding connection member 11, and abuts and tightly presses against the fan blade 30. The rotating block 53 has a first end hinged to the fastening member 51 and a second end hinged to a first end of the fastening member 55. The fastening member 55 is turned about the rotating block 53, and a second end of the fastening member 55 is fastened with another connection member 11.

The ceiling fan blade mounting structure 100 according to the present embodiment may be applied to a conventional ceiling fan, i.e., a ceiling fan having a function of driving indoor air to flow. The fan blade mounting structure may also be applied to a ceiling fan-lamp that further has a decorative function due to the combination of a lamp and a ceiling fan. Specifically, metal alloys may be used for the fan blade 30, such that wind produced by such a ceiling fan is relatively strong. Of course, the fan blade 30 may also be made of a wood composite board with relatively high strength, and a textured pattern may be formed on the surface of the fan blade 30, which not only forms a pleasant appearance, but also makes little noise during its operation. The blade holding base 10 may be made of metal materials like cast iron and manufactured by die casting. The surface of the blade holding base 10 may also be made in faded bronze, such that the overall ceiling fan is more pleasing to the eye.

During assembling, a first end of the blade holding base 10 is fixedly connected to the ceiling fan through a rotator driven by a motor, and the fan blade 30 is held by and fixed to a second end of the blade holding base 10. Driven by the motor, the rotator drives the fan blade 30 to rotate around the rotator, so as to realize indoor air convection through blowing indoor air.

According to the technical solution of the present disclosure, a plurality of connection members 11 are connected to the blade holding base 10. The fan blade 30 includes connection holes 31 whose number is the same as the number of the connection members, and a fastening assembly 50 is further provided. The connection members 11 of the blade holding base 10 are aligned with the connection holes 31 in the fan blade 30, the connection members 11 run through the connection holes 31, and then the at least two wedging arms 511' of the wedging member 51 wedges and presses the fan blade 30 tightly, and are fastened with at least two connection members 11. Because the fastening member 55, the rotating block 53 and the wedging member 51 in the fastening assembly 50, are hinged to each other, the fastening member 55 may be turned with respect to the wedging member 51. The fastening member 55 is fastened with another connection member 11 after being turned by a certain angle. And through a folding of the rotating block 53 and the fastening member 55 at the hinged portion, the fastening member 55 and the connection member 11 connected thereto move relative to each other, such that the connection member 11 further slides into the fastening member 55, and a fastening structure between the fastening member 55 and the connection member 11 is thereby locked. While the fan blade 30 is firmly fixed to the blade holding base 10 through at least three fastening connection formed by engagements of the at least two wedging arms 511', the fastening member 55 and the connection member 11, the fastening assembly 50 will not be easily detached from the connection members 11 due to looseness occurred in the rotation of the ceiling fan, thereby greatly improving the stability of the entire connection structure. Meanwhile, in the technical solution of the present disclosure, connection between the fan blade 30 and the blade holding base 10 may be tightened without screws, thereby greatly facilitating mounting the fan blades 30 onto and dismounting the fan blades 30 from the blade holding base 10.

Figure 11:
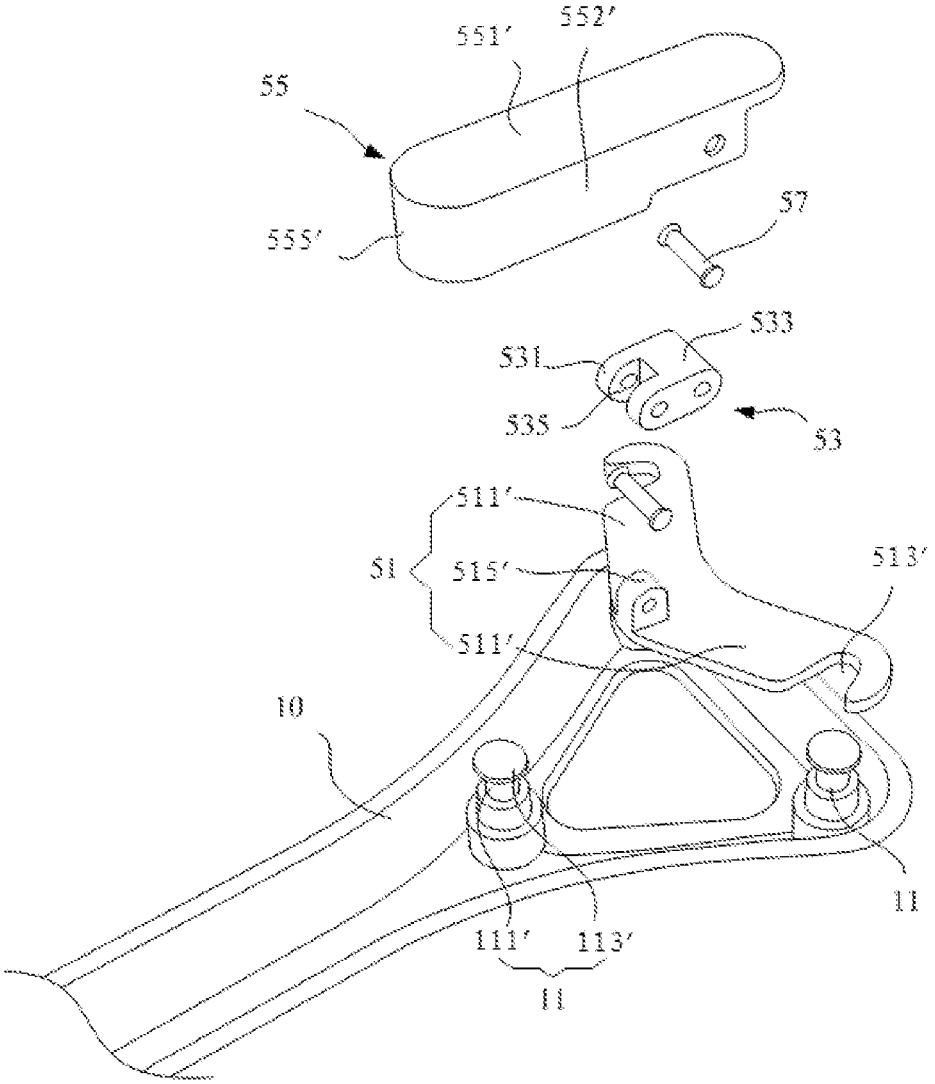
FIG. 11 is an exploded structural view of part of the ceiling fan blade mounting structure in FIG. 9, in which no fan blade is illustrated.

The wedging member 51 according to this embodiment is provided with two wedging arms 511'. The two wedging arms 511' are disposed at an angle therebetween. As illustrated in FIG. 11, first ends of the two wedging arms 511' are connected to each other, and second ends of the two wedging arms 511' extend away from each other. Furthermore, three connection members 11 are provided, and the three connection members 11 are arranged in a shape of an isosceles triangle (for example, an equilateral triangle). Preferably, the two wedging arms 511' according to this embodiment are arranged at an obtuse angle, such that the wedging member 51 has a satisfying structural strength. The three connection members 11 are arranged in a shape of an equilateral triangle. When the fastening assembly 50 is fastened with the connection members 11, during operation of the ceiling fan, shear force exerted on each connection member 11 is relatively even, such that the connection structure is more stably.

Furthermore, in this technical solution, on the basis that the blade holding base 10 is connected to the fan blade 30 through an engagement between the connection member 11 and the connection hole 31, at least one pin (not illustrated) may be provided on the blade holding base 10. The fan blade 30 defines mounting holes (not illustrated) equal in number to that of the pins. One pin is inserted into one mounting hole. Accordingly, through providing the pins, during the assembling of the fan blade 30 and the blade holding base 10, when the connection members 11 pass through the connection holes 31, the pins are also inserted into the mounting holes. Because a connection structure of the fan blade 30 and the blade holding base 10 bears relatively strong shear force during the operation of the ceiling fan, the pins may share some of the shear force exerted on the connection member 11, such that the connection structure between the fan blade 30 and the blade holding base 10 has a higher strength.

Specifically, each connection member 11 includes a second column 111' fixedly connected to the blade holding base 10. An end of the second column 111' away from the blade holding base 10 is provided with a second flange 113'. An end portion of each of the wedging arms 511' includes a third insertion opening 513'. The second column 111' of the connection member 11 mated with the wedging member 51 is snapped into the third insertion opening 513', and two sides of the second flange 113' of the connection member 11 are tightly pressed onto the two wedging arms 511'.

During a molding process of the connection member 11, a cylindrical protrusion with a threaded hole can be integrally molded with the blade holding base 10 during the die casting. And then, a partially-threaded screw is screwed into the cylindrical protrusion, thus the partially-threaded screw and the cylindrical protrusion constitute the connection member 11 in the present embodiment. Specifically, the second column 111' is a non-threaded screw arbor of the partially-threaded screw, and the second flange 113' is the cap of the partially-threaded screw. Of course, the connection member 11 may also be integrally formed with the blade holding base 10. The connection member 11 according to this embodiment is separate from the blade holding base 10, which may reduce molding cost of the blade holding base 10. The wedging member 51 in this embodiment is a metal die-casting part, and the wedging arm 511' has a certain thickness. In this manner, after the second column 111' of the connection member 11 is snapped into the third insertion opening 513', both of surfaces of the fan blade 30 and the second flange 113' are pressed on two corresponding surfaces on the wedging arms 511', such that the fan blade 30 may be prevented from moving in an axial direction of the connection member 11. Accordingly, a ceiling fan having the fan blade mounting structure according to the present disclosure has a relatively high structural strength during operation. In this embodiment, the wedging member 51 is fastened with the connection member 11 through slidable insertion, thus the installation is easy.

Specifically, the fastening member 55 includes a second bottom plate 551', as well as a fourth side plate 552', a fifth side plate 554' and a sixth side plate 555' each connected to an edge of the second bottom plate 551' and extending toward a side (for example, a side where the fan blade 30 is) of the second bottom plate 551'. The fourth side plate 552' and the fifth side plate 554' are oppositely arranged. The sixth side plate 555' is provided with a second fastening portion 557' extending toward (for example, toward the wedging member) a position between the fourth side plate 552' and the fifth side plate 554'. The second fastening portion 557' includes a fourth insertion opening 559'. The fastening member 55 rotates about the rotating block 53, such that the second column 111' of the another one of the plurality of connection members 11 connection member 11 slides into the fourth insertion opening 559' and the second flange 113' is tightly pressed on edges on both sides of the fourth insertion opening 559'. In other words, the fastening member 55 is turned about the rotating block 53, such that the second column 111' of the connection member 11 mated with the fastening member 55 slides into the fourth insertion opening 559', and the second flange 113' of the connection member 11 is tightly pressed onto edges on both sides of the fourth insertion opening 559'.

Optionally, the fastening member 55 is a plate made by stamping and bending. After the wedging member 51 is fastened with one of the connection members 11, the fastening member 55 is turned about the rotating block 53, such that the second fastening portion 557' faces an opening end of the fourth insertion opening 559'. Since the fastening member 55, the rotating block 53 and the wedging member 51 are hinged with each other, when the fourth insertion opening 559' faces the second column 111' of the connection member 11 after the fastening member 55 is turned about the rotating block 53 for a certain angle, the fastening member 55 and the connection member 11 slide relative to each other under the action of a force applied to the fastening member 55, such that the second column 111' of the connection member 11 slides and is snapped into the fourth insertion opening 559', and two sides of the second flange 113' of the connection member 11 are respectively tightly pressed onto the edges on the two sides of the fourth insertion opening 559'. The whole installation process is convenient and the connection structure is relatively firm.

In this embodiment, after the fastening member 55 is fastened with the connection member 11, the wedging member 51 and the rotating block 53 rotate with respect to each other, thereby forming an open configuration as a hinge. In addition, the rotating block 53 is located in a space covered by the fastening member 55. The fastening member 55 hides the rotating block 53. Accordingly, the entire structure is simple. In addition, it is possible to avoid noises made by the exposed rotating block 53 during the rotation of the ceiling fan.

Figure 12:
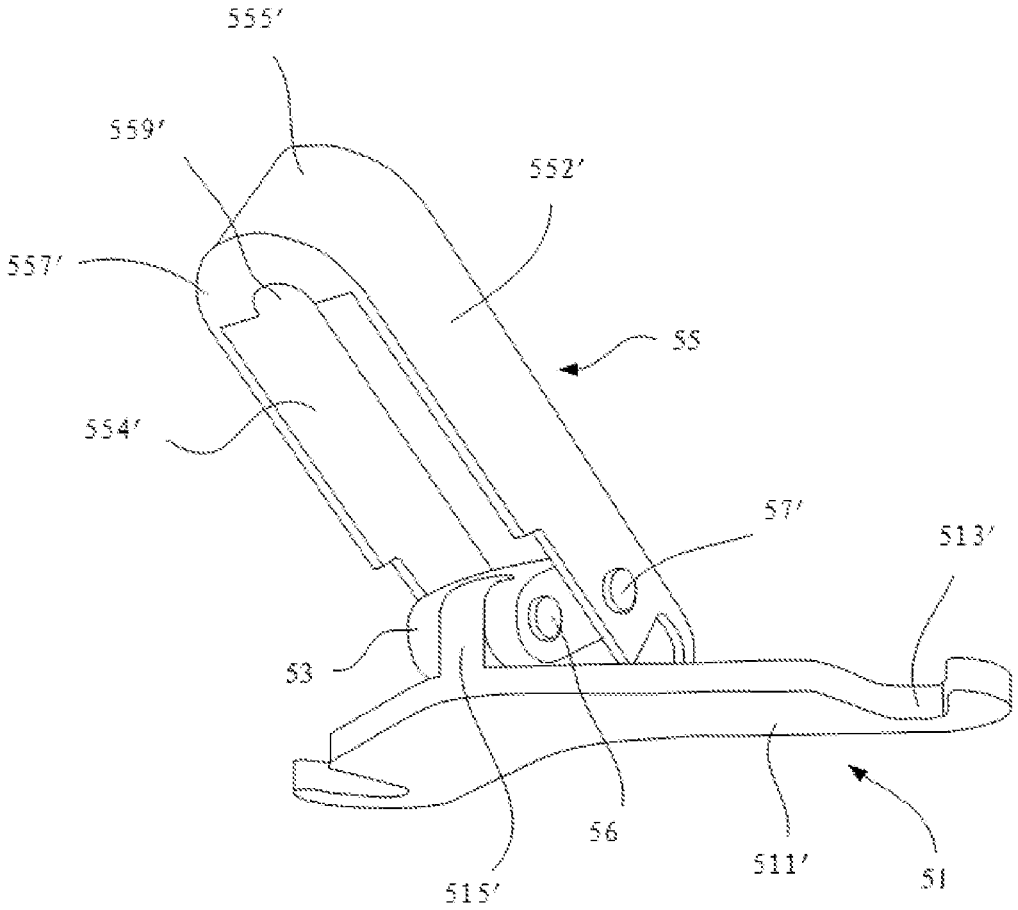
FIG. 12 is a schematic assembled structural view of a fastening assembling of a ceiling fan blade mounting structure according to embodiments of the present disclosure
Figure 13:
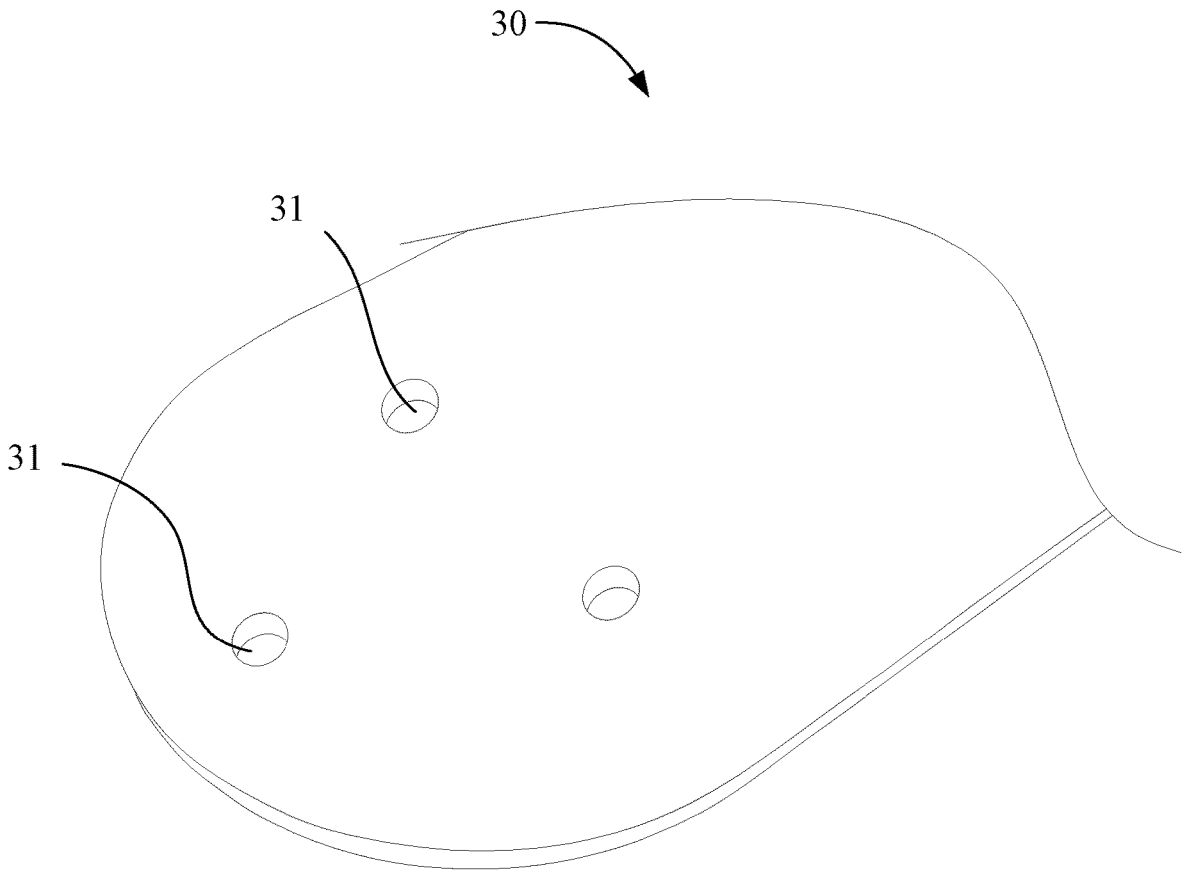
FIG. 13 is a schematic structural view of a fan blade of a ceiling fan blade mounting structure according to embodiments of the present disclosure.

The hinged structure formed by the fastening member 55, the rotating block 53 and the wedging member 51 will be described in detail with reference to FIG. 11 and FIG. 12.

The wedging member 51 further includes a second connecting arm 515' connected to the wedging arms 511'. The rotating block 53 has a first end 531. A limiting groove 535 is formed at the first end 531 of the rotating block 53. Third through holes matching each other are formed at the second connecting arm 515' and the first end 531 of the rotating block 53, respectively, and the wedging member 51 is hingedly connected to the rotating block 53 by means of a third rivet 56 running through the third through hole on each of the second connecting arm 515' and the first end 531 of the rotating block 53. Optionally, the rotating block 53 may be a die-casting part. With the first end 531 restricted in the limiting groove 535, the rotating block 53 is less likely to swing when it rotates about the rivet.

Furthermore, the rotating block 53 further includes a second end 533 extending into a position between the fourth side plate 552' and the fifth side plate 554' of the fastening member 55. Fourth through holes matching each other are formed at the second end 533 of the rotating block 53, the fourth side plate 552' and the fifth side plate 554', respectively. The fastening member 55 is hingedly connected to the rotating block 53 by means of a fourth rivet 57' running through the fourth through holes of the fourth side plate 552', the second end 533 of the rotating block 53 and the fifth side plate 554' sequentially. Similarly, the fourth side plate 552' and the fifth side plate 554' of the fastening member 55 restrict the second end 533 of the rotating block 53, thus the fastening member 55 moves more stably during the rotation.

The assembling process of the ceiling fan blade mounting structure 100 is described as follows.

The connection members 11 and the pins 13 are inserted into the connection holes 31 and the mounting holes 33 respectively, and then the third insertion opening 513' of the wedging member 51 and one connection member 11 are aligned. A force is applied to the fastening assembly 50 to make the second column 111' of the connection member 11 slide and snapped into the third insertion opening 513'. Meanwhile, the second flange 113' of the connection member 11 abuts against the wedging arms 511', such that the fan blade 30 is tightly connected to the blade holding base 10 through wedging and pressing by the wedging member 51.

A force is applied to the fastening member 55, the second fastening portion 557' of the fastening member 55 is turned to an external side of the connection member 11 mated with it, and the fourth insertion opening 559' faces the second column 111' of the connection member 11.

A further force is applied to the fastening member 55, the second column 111' of the connection member 11 slides and is snapped into the fourth insertion opening 559'. At the same time, the second flange 113' of the connection member 11 is clamped at edges on both sides of the fourth insertion opening 559'. And then, the fastening member 55 is pressed downwardly to make the wedging member 51 and the rotating block 53 rotate with respect to each other until the wedging member 51 and the rotating block 53 are in a state of like an open hinge. In addition, the rotating block 53 is hidden inside the fastening member 55. The assembling of the fan blade 30 and the blade holding base 10 is thereby completed.

In the process of disassembling, a force is applied to an end of the fastening member 55 adjacent to the wedging member 51, such that the end of the fastening member 55 adjacent to the wedging member 51 is raised, and the fastening member 55 brings the rotating block 53 to turn. When an angle of about 90 degrees is formed between the rotating block 53 and the wedging member 51, a force is applied to the fastening member 55 to make the fastening member 55 and the connection member 11 slide relative to each other, such that the connection member 11 detaches from the fastening member 55. And then the wedging member 51 is pulled out. In this manner, a locking state between the fan blade 30 and the blade holding base 10 is released, and thus the fan blade 30 may be separated from the blade holding base 10.

The present disclosure further provides a ceiling fan including a ceiling fan blade mounting structure 100. The fan blade mounting structure 100 has a specific structure referring to the above embodiments. Since the ceiling fan adopts all of the technical solutions of the above embodiments, it at least has all of the beneficial effects brought by the technical solutions of the above embodiments, thus the beneficial effects will not be described herein again.

Reference throughout this specification to "an embodiment", "some embodiments", "exemplary embodiments", "an example", "a specific example", or "some examples" means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Furthermore, the particular features, structures, materials, or characteristics may be combined in any suitable manner in one or more embodiments or examples.

Although embodiments of present disclosure have been shown and described above, it should be understood by those skilled in the art that changes, alternatives, and modifications can be made to the embodiments without departing from spirit and principles of the present disclosure. The scope of the present disclosure is limited by the attached claims and its equivalents.

What is claimed is:

1. A ceiling fan blade mounting structure comprising:

a blade holding base including a plurality of connection members spaced apart from each other;

a fan blade arranged at the blade holding base and including a plurality of connection holes in one-to-one correspondence with the plurality of connection members, each of the connection members running through one of the connection holes; and a fastening assembly comprising:

a wedging member fastened with one of the plurality of connection members and configured to abut and press the fan blade against the blade holding base;

a rotating block, a first end of the rotating block being rotatably connected to the wedging member; and a fastening member, a first end of the fastening member being rotatably connected to a second end of the rotating block, and the fastening member being configured to rotate about the rotating block to cause a second end of the fastening member to be fastened with another one of the plurality of connection members.

2. The ceiling fan blade mounting structure according to claim 1, wherein:

each of the connection members comprises a column fixedly connected to the blade holding base and including a flange arranged at an end of the column that is away from the blade holding base, the wedging member comprises two wedging portions, an insertion opening being formed between the two wedging portions, and the column of the one of the plurality of connection members is configured to be snapped in the insertion opening, and the flange of the one of the plurality of connection members is configured to abut against the two wedging portions.

3. The ceiling fan blade mounting structure according to claim 2, wherein:

the insertion opening is a first insertion opening;

the fastening member comprises:

a bottom plate; and a first side plate, a second side plate, and a third side plate each connected to an edge of the bottom plate and extending toward the fan blade, the first side plate and the second side plate being oppositely arranged, the third side plate including a fastening portion extending toward the wedging member and including a second insertion opening; and the fastening member is configured to rotate about the rotating block to cause the column of the another one of the plurality of connection members to slide into the second insertion opening and the flange of the another one of the plurality of connection members to abut against edges on both sides of the second insertion opening.

4. The ceiling fan blade mounting structure according to claim 3, wherein:

the wedging member further comprises two connecting arms connected to the wedging portions;

an end of the rotating block extends to a position between the two connecting arms;

through holes matching each other are formed at the two connecting arms and the end of the rotating block, respectively; and the wedging member is hinged to the rotating block via a rivet running through the through holes.

5. The ceiling fan blade mounting structure according to claim 4, wherein:

the end of the rotating block is a first end of the rotating block, the through holes are first through holes, and the rivet is a first rivet;

a second end of the rotating block is arranged between the first side plate and the second side plate;

second through holes matching each other are formed at the second end, the first side plate, and the second side plate, respectively; and the fastening member is hinged to the rotating block via a second rivet running through the second through holes.

6. The ceiling fan blade mounting structure according to claim 1, wherein the wedging member includes two wedging arms configured to be fastened with two of the plurality of connection members, respectively, and abut and press the fan blade against the blade holding base.

7. The ceiling fan blade mounting structure according to claim 6, wherein first ends of the two wedging arms are connected to each other and second ends of the two wedging arms extend away from each other.

8. The ceiling fan blade mounting structure according to claim 6, wherein:

each of the connection members comprises a column fixedly connected to the blade holding base and including a flange arranged at an end of the column that is away from the blade holding base;

an insertion opening is formed at an end portion of each of the wedging arms; and the column of one of the connection members is configured to be snapped in the insertion opening of one of the wedging arms, and the flange of the one of the connection members is configured to abut against the one of the wedging arms.

9. The ceiling fan blade mounting structure according to claim 8, wherein:

the insertion opening is a first insertion opening; and the fastening member comprises:

a bottom plate; and a first side plate, a second side plate, and a third side plate each connected to an edge of the bottom plate and extending toward the fan blade, the first side plate and the second side plate being oppositely arranged, the third side plate including a fastening portion extending toward the wedging member and including a second insertion opening; and the fastening member is configured to rotate about the rotating block to cause the column of the another one of the plurality of connection members slide into the second insertion opening and the flange of the another one of the plurality of connection members to abut against edges on both sides of the second insertion opening.

10. The ceiling fan blade mounting structure according to claim 9, wherein:

the wedging member further comprises a connecting arm connected to the wedging arms;

the rotating block includes a limiting groove formed at an end of the rotating block;

the connecting arm extends into the limiting groove;

through holes matching each other are formed at the connecting arm and the end of the rotating block, respectively; and the wedging member is hinged to the rotating block via a rivet running through the through holes.

11. The ceiling fan blade mounting structure according to claim 10, wherein:

the end of the rotating block is a first end of the rotating block, the through holes are first through holes, and the rivet is a first rivet;

a second end of the rotating block is arranged between the first side plate and the second side plate;

second through holes matching each other are formed at the second end of the rotating block, the first side plate, and the second side plate, respectively; and the fastening member is hinged to the rotating block via a second rivet running through the second through holes.

12. The ceiling fan blade mounting structure according to claim 1, wherein the plurality of connection members include three connection members arranged in a shape of an isosceles triangle.

13. The ceiling fan blade mounting structure according to claim 1, wherein the wedging member and the rotating block are located in a space covered by the fastening member.

14. The ceiling fan blade mounting structure according to claim 1, wherein:

the blade holding base further comprises pins;

the fan blade includes mounting holes;

a number of the pins equals a number of the mounting holes; and the pins are configured to be inserted in the mounting holes, respectively.

15. The ceiling fan blade mounting structure according to claim 14, wherein:

the plurality of connection members include two connection members; and the pins are oppositely provided on two sides of a line connecting the two connection members.

16. A ceiling fan comprising the fan blade mounting structure according to claim 1.

17. A ceiling fan blade mounting structure comprising:

a blade holding base including a plurality of connection members spaced apart from each other; and a fastening assembly comprising:

a wedging member fastened with one of the plurality of connection members;

a rotating block, a first end of the rotating block being rotatably connected to the wedging member; and a fastening member, a first end of the fastening member being rotatably connected to a second end of the rotating block, and the fastening member being configured to rotate about the rotating block to cause a second end of the fastening member to be fastened with another one of the plurality of connection members.

* * * * *